United States Patent [19]

Narozny

[11] 4,261,632

[45] Apr. 14, 1981

[54] COAXIAL CABLE CONNECTOR

[75] Inventor: Ronald S. Narozny, Panorama City, Calif.

[73] Assignee: Thomas & Betts Corporation, Raritan, N.J.

[21] Appl. No.: 28,721

[22] Filed: Apr. 9, 1979

[51] Int. Cl.[3] ..... H01R 11/20

[52] U.S. Cl. ..... 339/97 C; 339/100

[58] Field of Search ..... 339/97, 98, 99, 96, 339/177 E, 177 R, 100, 89 C, 223 R; 174/75 C

[56] References Cited

U.S. PATENT DOCUMENTS

| | | | |
|---|---|---|---|
| 2,476,429 | 7/1949 | Paules | 339/223 R X |
| 3,058,088 | 10/1962 | Miller | 339/97 C |
| 3,117,829 | 1/1964 | Leach | 339/97 P |
| 3,824,528 | 7/1974 | Esser | 339/177 R X |

FOREIGN PATENT DOCUMENTS

| | | | |
|---|---|---|---|
| 1490490 | 6/1969 | Fed. Rep. of Germany | 339/100 |
| 78788 | 12/1960 | France | 339/100 |

*Primary Examiner*—John McQuade
*Assistant Examiner*—John S. Brown
*Attorney, Agent, or Firm*—James J. Daley; Robert M. Rodrick; Jesse Woldman

[57] ABSTRACT

A coaxial cable connector for providing an electrical connection to a conductor of a coaxial cable, the conductor being surrounded by an insulating member. The connector comprises an elongated longitudinally extending sleeve member for arrangement coaxially about the insulating member. The longitudinally extending sleeve member includes a tongue member which is adapted to bend on a bending axis, which is transverse to the longitudinal direction of the sleeve member. The tongue member has a pair of spaced insulation piercing tines which are spaced apart less than the diameter of the conductor to be engaged. The pair of tines thus define a slot which is adapted to receive the conductor. In this manner, when the tongue member is bent along the transverse bending axis, the insulation piercing tines traverse the insulation and pass on opposite longitudinal sides of the conductor so that the conductor is received within the slot and engaged by the tines to make electrical contact with the conductor. Such a coaxial cable connector may be used for providing electrical connection to either the inner conductor of a coaxial cable or the outer annular conductor arranged about the insulation surrounding the inner conductor.

4 Claims, 6 Drawing Figures

COAXIAL CABLE CONNECTOR

BACKGROUND OF THE INVENTION

The present invention relates to an electrical connector for coaxial cable, and more particularly to electrical connectors for either or both of the conductors of coaxial cable. The connector may act as a termination, such as a plug or part of a union, for the coaxial cable so that the cable may be connected to a piece of equipment or to another cable having counterpart connectors terminating it.

In the art, the term "coaxial cable" signifies a cable comprising an inner conductor and an outer concentric conductor surrounding the inner conductor. An inner insulating member is interposed between the inner and outer conductors. The outer conductor may also be provided with an insulating member or sheath surrounding it so that both the inner and outer conductors are insulated from one another and from the exterior of the cable.

Various types of devices have been suggested in the prior art for terminating such coaxial cable. Many of these prior art coaxial cable terminating connectors have been comprised of a multitude of individual pieces which must be assembled onto the end of the coaxial cable and which have required special stripping operations for the cable and time-consuming shaping operations for the outer conductor. For example, U.S. Pat. No. 3,828,305 to Hogendobler discloses a terminal connector and method of attaching same to a coaxial cable in which a cylindrical plug member, an inner ferrule, and an outer ferrule are assembled onto the end of a coaxial cable and secured thereinplace via a single crimping operation. However, with such a terminal connector, a length of the coaxial cable must first be prepared by stripping the outer insulation, the shielding, and the dielectric sleeve to bare the inner conduction. The inner conductor is received in the plug member which in turn is inserted into the inner ferrule. The shielding or outer annular connector must be slightly flared so that during assembly the inner ferrule is inserted between the inner insulating member or dielectric and the shielding. The outer ferrule receives the inner ferrule with the cable shielding arranged between the inner and outer ferrules, and the outer ferrule is then crimped to secure the connector in place on the end of the cable. As can be appreciated, such an arrangement is both time-consuming and complex.

Other prior art connectors of a somewhat simplified nature have been suggested for the outer annular conductors in which an outer sleeve or ferrule is provided with a pair of spaced lances formed in the sidewall of the ferrules opposite one another so that when the ferrule is crimped to the coaxial cable, the lances will pierce the outer insulating sheath and pass between the strands of the outer annular conductor to provide for electrical contact therewith. Such a connector is shown, for example, in U.S. Pat. No. 3,824,528. Another similar arrangement is shown in U.S. Pat. No. 3,828,298 in which the outer insulating member is stripped to expose the braided annular shield and in which the terminal connector sleeve is provided with inwardly projecting lances which serve to lace the shield during assembly. With such connectors, overcrimping or undercrimping can cause problems. For example, overcrimping can inadvertently cause the lances to engage the inner conductor. On the other hand, insufficient crimping pressure may result in insufficient electrical contact being made.

SUMMARY OF THE INVENTION

These and other disadvantages of the prior art are overcome with the improved cable connector of the present invention. In accordance with the present invention, there is provided a connector for a conductor of a cable. The connector comprises a longitudinally extending sleeve member having a tongue member in the wall thereof. The tongue member includes a depending arm having a pair of spaced insulation piercing tines defining a slot therebetween. The tongue member is movable about an axis transverse to the longitudinal direction of the sleeve member between a first position in which the tines lie outside the periphery of the sleeve member and a second position in which the tines lie within the periphery of the sleeve member. In this way, the sleeve member may be coaxially arranged on an insulating member surrounding the conductor of a cable when the tongue member is in the first position. The tongue member may then be bent along the transverse axis to the second position, so that the insulation piercing tines will traverse the insulation and engage the conductor on opposite longitudinal sides thereof to capture and retain the conductor in electrical contact with the insulation piercing tines.

The connector of the present invention may be used for either the inner conductor of a coaxial cable in which case the insulating member comprises the inner insulating dielectric material, or the outer annular conductor, in which case the outer insulating material or sheath comprises the insulating member. Further, it is to be noted that if the connector is to provide electrical connection to the outer conductor, the spacing between the insulation piercing tines is less than the diameter of the outer annular conductor but greater than the diameter of the inner conductor so that the connector will not engage the inner conductor.

The connector of the present invention is advantageous in that the longitudinally extending sleeve member need only be slid onto the insulation and the tongue member depressed to pierce the insulation and capture the conductor in the slot defined by the insulation piercing tines. Preferably, the insulation piercing tines are substantially flat and lie in a common plane so that the tines are not easily moved apart or toward one another to change the spacing of a slot.

Furthermore, since the tines serve to pierce the insulation, the insulation surrounding the outer conductor to be engaged need not be stripped prior to affixing the connector to the cable. If the conductor to be connected comprises the inner conductor, only the outer insulation and outer annular conductor need be removed from a portion of the coaxial cable. Further, no special shaping of the annular conductor or of the insulation is required to permit electrical connection to the conductor.

These and further features and characteristics of the present invention will be apparent from the following detailed description in which reference is made to the enclosed drawings which illustrate the preferred embodiment of the present invention.

DETAILED DESCRIPTION OF THE PREFERRED EMBODIMENT

Figure 1:
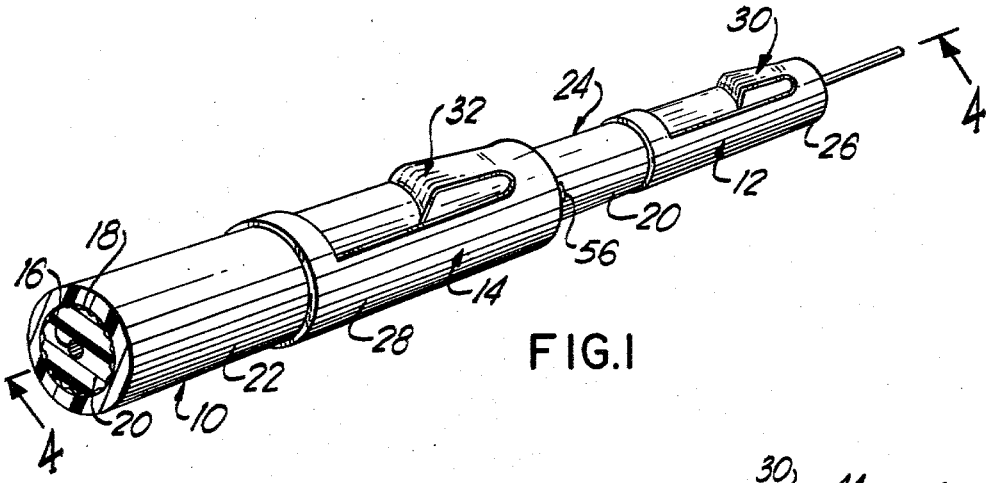
FIG. 1 is a perspective view of a coaxial cable provided with connectors in accordance with the present invention for each of the conductors.

Referring now to the drawings in which like reference characters represent like elements, there is shown in FIG. 1 a coaxial cable 10 having first and second terminal connectors 12, 14 for providing electrical connection to the inner conductor 16 and the outer annular conductor 18 respectively of the coaxial cable 10. The coaxial cable 10, as is conventional, includes an inner conductor 16, a dielectric or insulating member 20 surrounding the inner conductor 16, and an outer annular conductor 18 coaxially arranged about the inner dielectric or insulating member 20. Also, in the preferred embodiment, there is provided an outer insulating sheath 22 for the outer annular conductor 18. The inner conductor 16 of the coaxial cable 10 may either be comprised of stranded wire or of a relatively thick single filament, whereas the outer conductor 18 is generally in the form of a braided screen sheath comprised of a plurality of wire filaments braided together and concentrically arranged about the inner conductor 16 and the inner insulating member 20. Where the inner conductor 16 is to be terminated, the coaxial cable 10 is prepared by removing only the outer sheath 22 and the outer annular conductor or shield 18 from a portion 24 of the cable 10 to leave an exposed end of the cable 10. The inner dielectric or insulating member 20 is not removed, as this insulating member 20 serves as the member about which the terminal connector 12 is arranged.

Figure 2:
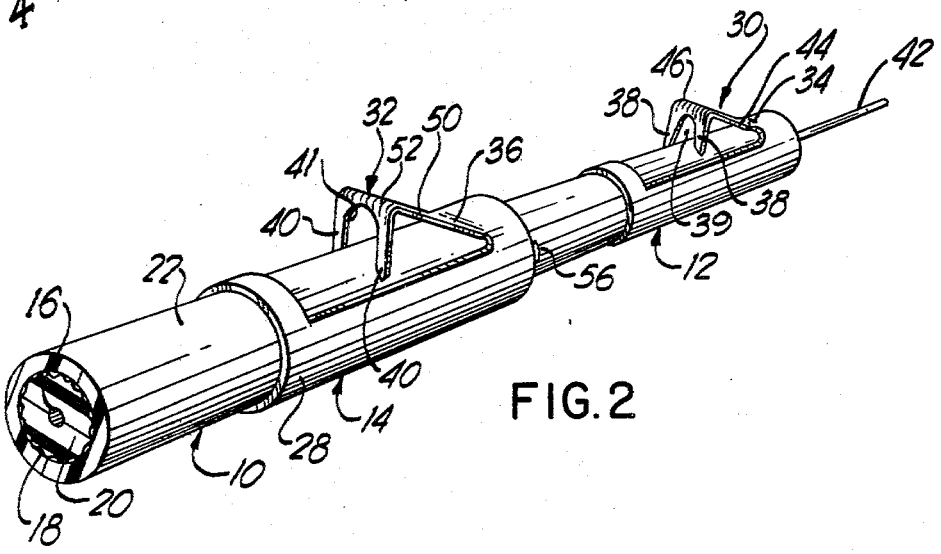
FIG. 2 is a perspective view, similar to that shown in FIG. 1, but with the connectors shown in a non-engaging position prior to the tongue members being bent along the transverse bending axis.
Figure 3:
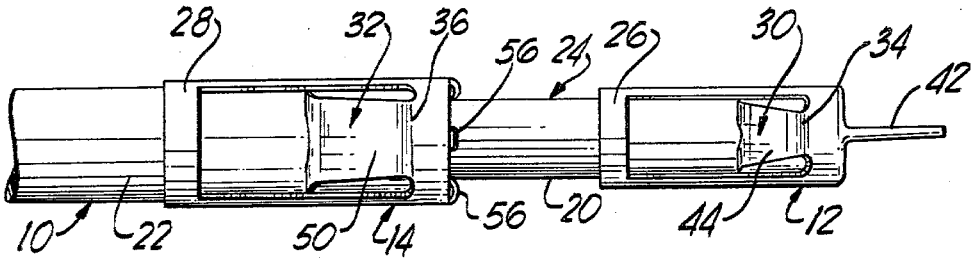
FIG. 3 is a top plan view of the coaxial cable with the connectors secured thereto.

Referring now to the remaining FIGS. 2-6, each of the terminal connectors 12, 14, whether for the inner conductor 16 or the outer annular conductor 18, is comprised of a longitudinally extending metallic sleeve member 26, 28 which is adapted to be slid onto the insulating member 20 or 22 surrounding the conductor 16 or 18 to which it is to be connected. The longitudinally extending sleeve member 26, 28 is generally cylindrical and includes a tongue member 30, 32 in the wall thereof which is adapted to bend about an axis 34, 36 transverse to the longitudinal direction of the sleeve member 26, 28. The tongue member 30, 32 includes a pair of insulation piercing tines 38, 40 which are spaced to define a slot 39, 41 therebetween. The tines 38, 40 are substantially flat and are of a substantial width as compared to the thickness (see FIGS. 4-6) so that the tines 38, 40 are not easily movable apart from or toward one another in the plane thereof to change the width of the slot 39, 41 defined therebetween. The spacing of the tines 38, 40 is chosen to provide a slot 39, 41 having a width which is slightly less than the diameter of the conductor 16, 18 to be engaged. Thus, the conductor 16, 18 will be captured and retained in the slot 39, 41 defined between the tines 38, 40 when the tongue member 30, 32 is depressed into the insulation to engage the conductor 16, 18 (i.e., the FIG. 1 position). In this regard, it is to be noted that prior to assembly, the tongue member 30, 32 is inclined upwardly, as shown in FIG. 2, so that the tips of the insulation piercing tines 38, 40 lie outside of the inner cylindrical surface defined by the sleeve 26, 28 in order to be able to slide the sleeve 26, 28 onto the corresponding insulation member 20, 22. When the tongue member 30, 32 is depressed, the insulation piercing tines 38, 40 slice or pierce the insulation to allow the tongue member 30, 32 to bend easily about the axis 34, 36 with the tines 38, 40 passing on opposite sides of the conductor 16, 18 and in engagement therewith to make the desired electrical contact.

More particularly, when the terminal connector is designed to terminate the inner conductor 16 of the coaxial cable 10, the sleeve member 26 preferably includes a pin end 42 or other type of suitable contact for connection to an appropriate piece of equipment or other component. The sleeve member 26 comprises a substantially cylindrical member having a tongue member 30 formed in the longitudinal surface thereof. In the preferred embodiment, the tongue member 30 includes first and second arm portions 44, 46. The first arm portion 44 extends rearwardly from the bending axis 34 and the second arm portion 46 extends downwardly from the free end of the first arm portion 44. The second arm portion 46 (as well as the first arm portion 44) is substantially flat or planar and terminates in the pair of spaced insulation piercing tines 38.

Figure 4:
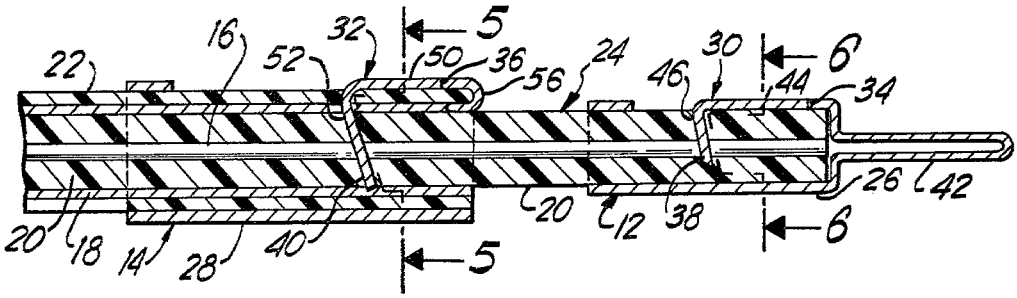
FIG. 4 is a side elevational view of a coaxial cable shown in FIG. 3.

As can best be seen in FIGS. 2 and 4, the downwardly depending second arm portion 46 of the tongue member 30 is bent to a position in which the angle between the first and second arm portions 44, 46 of the tongue member 30 is less than 90°. This is advantageous so that when the tongue member 30 is in its open position (shown in FIG. 2), the plane of the insulation piercing tines 38 will be substantially perpendicular to the surface of the insulating member 20 to provide easy insertion of the tines 38 into the insulating member 20 by depressing the tongue member 30 about the transverse axis 34. This easy insertion is also aided by the fact that the lower extremities 48 of the insulation piercing tines 38 are both sharp or pointed.

Figure 6:
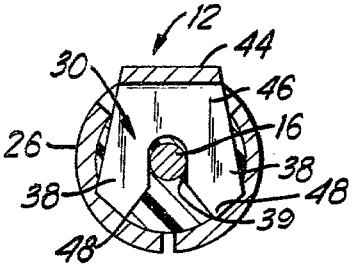
FIG. 6 is a cross-sectional view taken along lines 6—6 showing the other connector in engagement with the inner annular conductor of the coaxial cable.

As can best be seen in FIG. 6, the inner edges of the insulation piercing tines 38 define a slot 39 having a width which is less than the outer diameter of the central or inner conductor 16. In this way, when the tongue member 30 is depressed downwardly into the closed engaging position (i.e., the position shown in FIGS. 1 and 4), the insulation piercing tines 38 will slice the insulation 20 and engage the conductor 16 on opposite sides. Because the spacing is less than the outer diameter of the conductor 16, the inner conductor 16 may be slightly grooved in being captured by the insulation piercing tines 38, which is advantageous in ensuring good electrical contact and in maintaining engagement of the connector 12 with the conductor 16. Additionally, the connector 12 will be held in position on the coaxial cable 10 by the insulation 20 surrounding the inner conductor 16.

Thus, the connector 12 can be assembled and secured to the end of the coaxial cable 10 via a single operation used to bend the tongue member 30 downwardly about the transverse bending axis 34. It is to be noted that because the sleeve member 26 is made of relatively thin metal, it will be easily bent on this axis 34. At the same time, however, because of the relatively large planar surface area of the second arm portion 46, the insulation piercing tines 38 will not be easily movable in the plane of the arm 46 to change the width of the slot 39 defined therebetween, thereby ensuring that the conductor 16 will be captured by the tines 38.

The terminal connector 14 for the outer shield 18 of the coaxial cable 10 is similar to the terminal connector 12 for the inner conductor 16. In particular, the connector 14 comprises a longitudinally extending sleeve member 28 provided with a tongue member 32 adapted to bend about an axis 36 transverse to the longitudinal direction of the sleeve 28. The tongue member 32 includes a first arm portion 50 affixed to the sleeve 28 which is inclined away from the sleeve 28 in an open position (see FIG. 2) and a downwardly depending arm portion 52 which, in the preferred embodiment, is bent at less than a 90° angle with respect to the first arm portion 50. As with the connector 12 for the inner conductor 16, the second arm portion 52 is substantially planar and terminates in a pair of spaced tines 40 defining a slot 41 therebetween. Each of the tines 40 is provided with a sharp or pointed end 54 for insulation piercing purposes, and the spacing between the inner edges of the tines substantially corresponds to the inner diameter of the outer annular conductor 18.

As can best be seen in FIG. 4, the forward end of the sleeve member 28 is provided with a plurality of tangs 56 which are formed as extensions of the sleeve member 28 and bent inwardly thereof to define, with the sleeve member 28, a U-shaped cross section. The spacing between the sleeve 28 and the inwardly bent tangs 56 corresponds substantially to the thickness of the outer insulation sleeve or jacket 22 of the coaxial cable 10. The tangs 56 are adapted to be pressed into engagement with the outer annular conductor 18 when the sleeve member 28 is slid onto the outer jacket 22 to provide redundancy contact in addition to the contract provided by the insulation piercing tines 40. In the embodiment shown, there are three tangs 56 (see FIG. 3) provided about the periphery of the sleeve member 28. It is to be noted that the annular conductor 18 does not need to be shaped or flared to permit the tangs 56 to be forced into engagement therewith.

Figure 5:
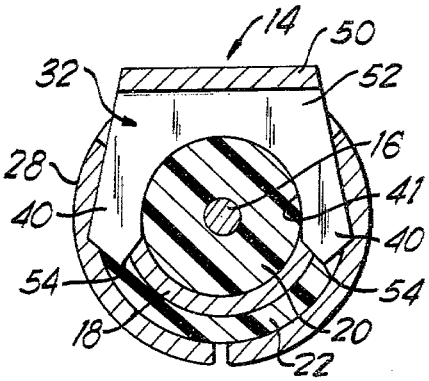
FIG. 5 is a cross-sectional view taken along lines 5—5 of FIG. 4 showing one of the connectors engaging the outer conductor of the coaxial conductor.

As can best be seen in FIG. 5, the spacing between the insulation piercing tines 40 on the tongue member 32 preferably corresponds to the outer diameter of the inner dielectric insulation member 20, so that substantially the entire thickness of the annular conductor 18 is engaged and captured by the insulation piercing tines 40 when the tongue member 32 is bent into the closed position.

Again, it is to be noted that by virtue of the substantially large planar surface of the depending second arm portion 46, the tines 40 are not easily bent open or close, which might otherwise affect a good electrical contact being made when the tongue member 32 is depressed to pierce the insulation 22 and capture the annular conductor 18.

In accordance with the present invention, only a minimum number of parts or components are required for terminating the conductors 16, 18 of a coaxial cable 10, and only a minimum number of assembly steps are necessary for securing the connectors 12, 14 to the cable 10. The connectors 12, 14 may each be easily formed from a flat metal blank in a conventional manner, with the tongue members 30, 32 being stamped thereoutof and bent to provide the desired shape and configuration. Thus, only a single metal component is needed for providing each of the connections. Further, machining is minimal, and the connectors 12, 14 may be easily formed in a few, simple conventional forming shapes. As for securing the connectors 12, 14 to the cable 10, the longitudinally extending sleeve member 28 is simply slid onto the outer sheath 22 when the outer annular conductor 18 is to be terminated, and the tongue member 32 then crimped. If the inner conductor 16 is to be terminated, only the outer sheath 22 and outer annular conductor 18 need be removed prior to sliding the longitudinally extending sleeve member 26 onto the inner insulating member 16 and crimping the tongue member 30.

Although this invention has been described with respect to its preferred embodiments, it should be understood that many variations and modifications will be obvious to those skilled in the art, and it is preferred, therefore, that the scope of the invention be limited, not by the specific disclosure herein, but only by the appended claims.

What is claimed is:

1. In combination, a coaxial cable having an inner conductor surrounded by a first insulating member, an annular conductor surrounding the first insulating member, and a second insulating member surrounding the annular conductor, and first and second terminal connectors for providing electrical connection to said inner conductor and said annular conductor, respectively, said second terminal connector comprising a longitudinally extending sleeve member coaxially arranged about said second insulating member at a position spaced from said first terminal connector, said sleeve member including insulation piercing means for piercing said second insulating member and engaging said annular conductor at opposite longitudinal sides thereof substantially transverse the longitudinal direction of said sleeve member and contact means depending longitudinally from said sleeve member and beneath a portion of the longitudinal peripheral extent of said sleeve member for engaging said annular conductor in a longitudinal direction.

2. The combination of claim 1, wherein said sleeve member of said second terminal connector comprises a substantially cylindrical sleeve adapted to be coaxially arranged about said second insulating member, said first terminal connector comprising a first longitudinally extending substantially cylindrical sleeve member coaxially arranged about a first exposed cable portion comprising only said inner conductor and the first insulating member, said first connector further including a pin member extending coaxially of said first cylindrical sleeve member.

3. The combination of claim 2, wherein said contact means comprises a plurality of tangs extending around an end portion of said second insulating member and radially inwardly thereof.

4. The combination of claim 1, wherein said first terminal connector comprises a first longitudinally extending sleeve member coaxially arranged about a first exposed cable portion comprising only said inner conductor and the first insulating member, said first sleeve member including insulation piercing means for piercing said first insulating member and engaging said inner conductor at opposite longitudinal sides thereof substantially transverse the longitudinal direction of said first sleeve member.

* * * * *